US012269140B2

(12) United States Patent
Kang et al.

(10) Patent No.: US 12,269,140 B2
(45) Date of Patent: Apr. 8, 2025

(54) SUBSTRATE POLISHING APPARATUS

(71) Applicant: Samsung Display Co., Ltd., Yongin-Si (KR)

(72) Inventors: Seungbae Kang, Suwon-si (KR); Joon-hwa Bae, Suwon-si (KR); Heesung Yang, Seoul (KR); Woojin Cho, Yongin-si (KR); Byoungkwon Choo, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 1357 days.

(21) Appl. No.: 16/411,141

(22) Filed: May 14, 2019

(65) Prior Publication Data

US 2019/0389027 A1 Dec. 26, 2019

(30) Foreign Application Priority Data

Jun. 22, 2018 (KR) ..... 10-2018-0071878

(51) Int. Cl.

| | |
|---|---|
| ***B24B 7/24*** | (2006.01) |
| ***B24B 27/00*** | (2006.01) |
| ***B24B 29/02*** | (2006.01) |
| ***B24B 37/04*** | (2012.01) |
| ***B24B 41/047*** | (2006.01) |

(52) U.S. Cl.

CPC ..... *B24B 29/02* (2013.01); *B24B 7/242* (2013.01); *B24B 27/0076* (2013.01); *B24B 41/047* (2013.01); *B24B 41/0475* (2013.01)

(58) Field of Classification Search

CPC ..... B24B 29/02; B24B 7/228; B24B 7/24; B24B 7/242; B24B 27/0015; B24B 27/0076; B24B 37/04; B24B 37/07; B24B 37/10; B24B 41/047; B24B 41/0475

USPC ... 451/41, 60, 163, 166, 173, 270, 271, 285, 451/287, 288

See application file for complete search history.

(56) References Cited

U.S. PATENT DOCUMENTS 3,107,463 A * 10/1963 Davis, Jr. ..... B24B 7/241 451/60
3,176,441 A * 4/1965 Walters ..... B24B 7/247 451/60

(Continued)

FOREIGN PATENT DOCUMENTS

JP H0911118 1/1997
JP 2008296288 12/2008

(Continued)

*Primary Examiner* — Eileen P Morgan
(74) *Attorney, Agent, or Firm* — CANTOR COLBURN LLP

(57) ABSTRACT

A substrate polishing apparatus including a stage configured to load a substrate, the stage having a flat surface, which is parallel to a first direction and a second direction, and on which the substrate is loaded, a pressing unit configured to exert a pressure on the substrate in a third direction, a rotary unit configured to revolve the pressing unit around a central axis parallel to the third direction, when viewed in a plan view, a plurality of polishing pads provided between the pressing unit and the substrate to be in contact with the substrate, and a nozzle part configured to supply a slurry onto the substrate. The polishing pads may be spaced apart from each other in a direction and may have a rectangular shape in the plan view.

17 Claims, 11 Drawing Sheets

(56) References Cited

U.S. PATENT DOCUMENTS

| | | | | | |
|---|---|---|---|---|---|
| 4,972,630 | A * | 11/1990 | Seki | B24B 41/0475 15/88.1 |
| 6,155,913 | A | 12/2000 | Quek | |
| 6,380,086 | B1 * | 4/2002 | Robinson | B24B 37/105 438/692 |
| 9,969,047 | B2 * | 5/2018 | Cho | B24B 27/0076 |
| 2019/0061109 | A1 * | 2/2019 | Takenouchi | B24B 7/228 |
| 2021/0008685 | A1 * | 1/2021 | Nam | H01L 21/31053 |

FOREIGN PATENT DOCUMENTS

| | | | | |
|---|---|---|---|---|
| JP | 2012121095 | A | 6/2012 | |
| KR | 20070121205 | A | 12/2007 | |
| KR | 10-2009-0062147 | | 6/2009 | |
| KR | 10-2009-0070939 | | 7/2009 | |
| KR | 10-2009-0089196 | | 8/2009 | |
| KR | 10-1583432 | | 12/2015 | |
| KR | 10-2016-0128541 | | 11/2016 | |
| KR | 10-1678992 | | 11/2016 | |
| KR | 20180033991 | A | 4/2018 | |
| TW | 436379 | | 5/2001 | |
| WO | WO-2007014732 | A2 * | 2/2007 | B24B 13/015 |
| WO | 2016161945 | | 10/2016 | |

* cited by examiner

SUBSTRATE POLISHING APPARATUS

CROSS-REFERENCE TO RELATED APPLICATIONS

This application claims priority from and the benefit of Korean Patent Application No. 10-2018-0071878, filed on Jun. 22, 2018, which is hereby incorporated by reference for all purposes as if fully set forth herein.

BACKGROUND

Field

Exemplary embodiments of the invention relate generally to a substrate polishing apparatus and, more specifically, to a substrate polishing apparatus which is used to fabricate a display panel.

Discussion of the Background

In general, a display device includes a plurality of electronic devices that are used to operate pixels. When the display device is fabricated, the electronic devices are formed on a substrate. For example, the electronic devices are formed by stacking a plurality of insulating layers and a plurality of conductive layers on a base substrate.

Each of the stacked layers may be formed to have an uneven top surface. In addition, in the case where there is an outer contamination material or an error in a process of forming the base substrate, the base substrate may also have an uneven top surface. A substrate polishing apparatus is used to planarize the top surface of the base substrate or the top surface of each of the layers using slurry. In case that the area of the base substrate is large, it becomes necessary to control the uniformity in each of small unit areas. It then becomes possible to polish or planarize uniformly over the entire surface of the base substrate, and the accuracy of polishing or planarizing appears to be improving.

The above information disclosed in this Background section is only for understanding of the background of the inventive concepts, and, therefore, it may contain information that does not constitute prior art.

SUMMARY

Exemplary embodiments of the present invention provide a substrate polishing apparatus, which can be used to uniformly polish a substrate.

Exemplary embodiments of the present invention also provide a substrate polishing apparatus having improved polishing efficiency.

Additional features of the inventive concepts will be set forth in the description which follows, and in part will be apparent from the description, or may be learned by practice of the inventive concepts.

An exemplary embodiment of the present invention provides a substrate polishing apparatus including a stage configured to load a substrate, the stage having a flat surface, which is parallel to a first direction and a second direction, and on which the substrate is loaded, a pressing unit configured to exert a pressure on the substrate in a third direction perpendicular to the first and second directions, a rotary unit connected to the pressing unit, the rotary unit being configured to revolve the pressing unit around a central axis parallel to the third direction, when viewed in a plan view, a plurality of polishing pads provided between the pressing unit and the substrate and used to polish the substrate, and a nozzle part configured to supply a slurry onto the substrate. The polishing pads may be spaced apart from each other in a direction parallel to a motion of the substrate.

The nozzle part may be provided between the polishing pads.

The pressing unit may include a plurality of pressing parts, which are spaced apart from each other in the first direction, and the polishing pads may be coupled to the pressing parts, respectively.

All of the pressing parts may exert the same pressure on the substrate.

The pressing parts may exert different pressures on the substrate.

The nozzle part may include a plurality of nozzle parts, which are coupled to the rotary unit, and the pressing parts and the plurality of nozzle parts may be alternately arranged in the first direction.

The pressing unit may include a single pressing part, and the polishing pads may be coupled in common to the single pressing part.

The nozzle part may include a plurality of holes, which are defined in the pressing unit and are spaced apart from each other in the second direction.

The pressing unit may further include a swelling part provided between the pressing unit and the polishing pad. The swelling part may be configured to have a changeable thickness, thereby allowing the polishing pad to exert a pressure on the substrate.

The pressing unit may be configured to have a changeable length in the third direction, thereby allowing the polishing pad to exert a pressure on the substrate.

A width of each of the polishing pads in the first direction may be less than 100 mm/n, where n is the number of the polishing pads.

The width of each of the polishing pads in the first direction may be less than 25 mm.

When measured in the second direction, a length of each of the polishing pads may be larger than a length of the substrate.

The substrate may include a glass substrate.

The stage may be configured to move the substrate in the first direction.

Another exemplary embodiment of the present invention provides a substrate polishing apparatus including a rotary unit configured to revolve around a central axis, when viewed in a plan view defined by a first direction and a second direction, the central axis being parallel to a third direction perpendicular to the first and second directions, a pressing unit connected to the rotary unit and configured to have a controllable length in the third direction, and a plurality of polishing pads coupled to the pressing unit. The pressing unit is used to change positions in the third direction of the polishing pads. The polishing pads are arranged to be spaced apart from each other in the first direction. Each of the polishing pads has a tetragonal or rectangular shape, when viewed in a plan view.

The polishing pads may be provided to have the same position in the third direction.

The pressing unit may include a plurality of pressing parts spaced apart from each other in the first direction. The polishing pads may be coupled to the pressing parts, respectively, and the pressing parts may be configured to have independently controllable lengths in the third direction.

The substrate polishing apparatus may further include a nozzle part, which is provided between the polishing pads and is used to provide a slurry.

The substrate polishing apparatus may further include a swelling part, which is provided between the polishing pads and the pressing unit and has a controllable thickness in the third direction. Positions, in the third direction, of the polishing pads may be changed by the controllable length, in the third direction, of the pressing unit and the controllable thickness, in the third direction, of the swelling part.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
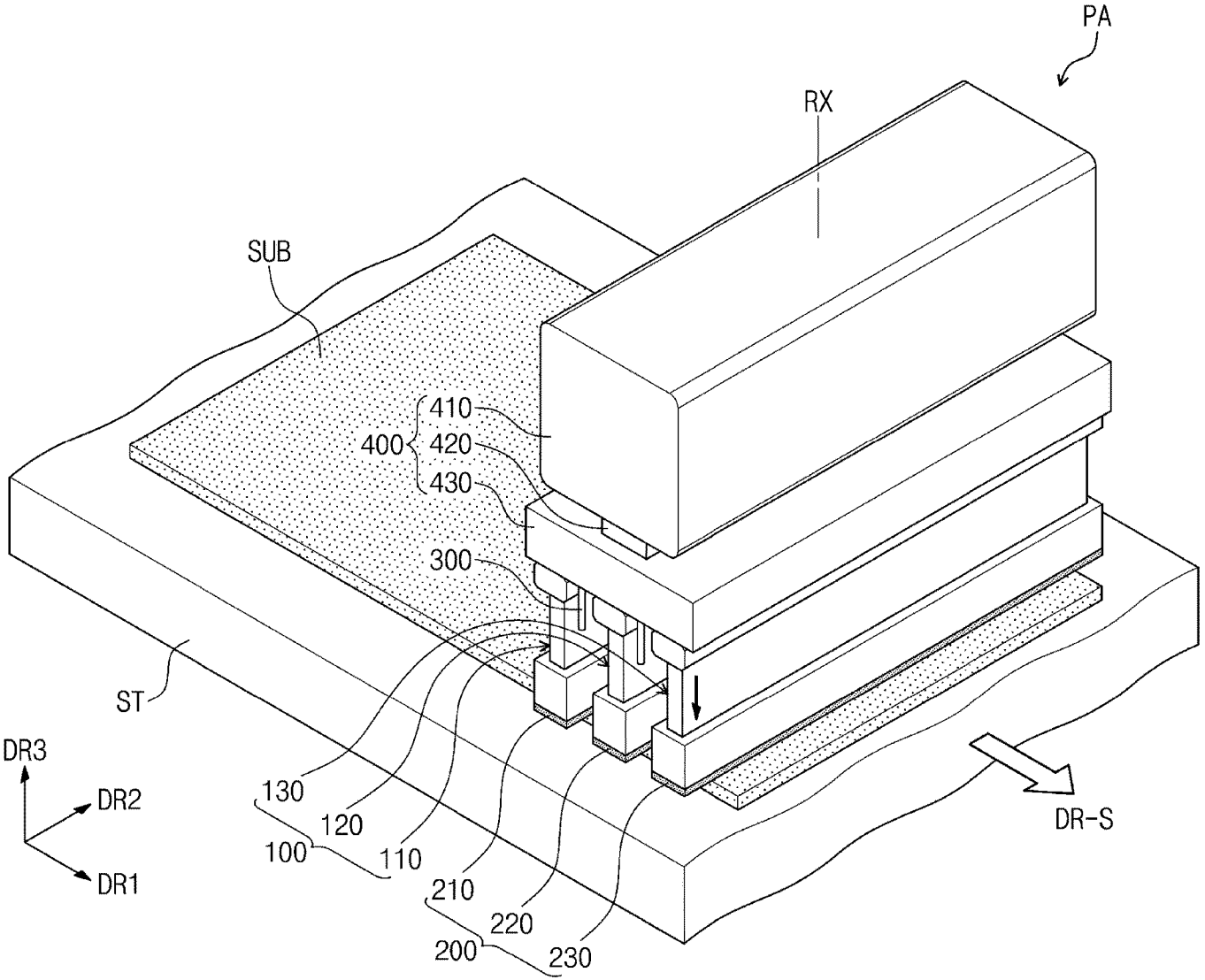
FIG. 1 is a perspective view illustrating a substrate polishing apparatus according to an exemplary embodiment of the inventive concept.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a perspective view illustrating a substrate polishing apparatus according to an exemplary embodiment of the inventive concept. As shown in FIG. 1, a substrate polishing apparatus PA may include a stage ST, a pressing unit 100, a plurality of polishing pads 200, a nozzle part 300, and a rotary unit 400. The substrate polishing apparatus PA may be configured to perform a polishing process on a top surface of a substrate SUB.

The stage ST may be configured to provide a flat surface that is parallel to two different or orthogonal directions (e.g., first and second directions DR1 and DR2). The substrate SUB may be loaded on the flat surface of the stage ST. In an exemplary embodiment, each of the directions may represent both of a direction, which is indicated by the corresponding arrow, and an opposite direction thereof.

When viewed in a plan view, the substrate SUB may have a rectangular shape, whose long sides are parallel to the first direction DR1, and whose short sides are parallel to the second direction DR2. The substrate polishing apparatus PA may be configured to polish the top surface of the substrate SUB.

The substrate SUB may be an insulating substrate. For example, the substrate SUB may include a glass substrate. However, the inventive concept is not limited to this example, and in an exemplary embodiment, the substrate SUB may include a plastic substrate.

The substrate SUB may correspond to a base layer of a display panel, which is configured to display an image. For example, if the display panel is composed of a plurality of insulating layers and a plurality of conductive layers provided on the base layer, the substrate SUB may correspond to the base layer. Alternatively, the substrate SUB may be provided in the form of a multi-layered structure including the base layer and at least one insulating or conductive layer provided on the base layer.

The substrate polishing apparatus PA may be used to planarize the top surface of the substrate SUB. In the case where the substrate SUB has the planarized top surface, it may be possible to stably form a plurality of layers on the substrate SUB. Alternatively, the substrate polishing apparatus PA may be used to planarize a top surface of a layer, which may become uneven when a plurality of layers are stacked on the substrate SUB using a thin-film process, and this may make it possible to stably perform a subsequent thin-film process. A substrate polishing apparatus according to an exemplary embodiment of the inventive concept may be used to perform a planarization process in various process steps.

For convenience in description, a relative motion DR-S of the substrate SUB is exemplarily illustrated in FIG. 1. Here, the relative motion DR-S of the substrate SUB may mean a motion of the substrate SUB relative to the substrate polishing apparatus PA (in particular, the polishing pads 200). As shown in FIG. 1, a direction of the relative motion DR-S of the substrate SUB may be parallel to the first direction DR1.

The relative motion DR-S of the substrate SUB may occur when the substrate SUB is moved by the stage ST. However, the inventive concept is not limited to this example, and in an exemplary embodiment, the relative motion DR-S of the substrate SUB may occur when the stage ST and the substrate SUB may be fixed and the polishing pads 200 is moved in a direction opposite to the first direction DR1.

The pressing unit 100 may be configured to be linearly movable in a third direction DR3. The linear motion of the pressing unit 100 may be used to exert a pressure on the substrate SUB. For example, the pressing unit 100 may be configured to allow the polishing pads 200 to be in close contact with the substrate SUB.

In addition, the pressing unit 100 may be configured to be linearly movable in a roundtrip manner in the second direction DR2. In the case where, when measured in the second direction DR2, a length of the substrate SUB is greater than a length of the polishing pads 200, the linear motions of the pressing unit 100 in both of the first and second directions DR1 and DR2 may be combined to allow the polishing process to be uniformly performed on the entire top surface of the substrate SUB. Nevertheless, the inventive concept is not limited to this example, and in an exemplary embodiment, the pressing unit 100 may be designed to perform various other linear motions, in consideration of the area of the substrate SUB.

In the present exemplary embodiment, the pressing unit 100 may include a plurality of pressing parts. In the present exemplary embodiment, the pressing parts may include first to third pressing parts 110, 120, and 130. The first to third pressing parts 110, 120, and 130 may be arranged to be spaced apart from each other in the direction of the relative motion DR-S of the substrate SUB. In the present exemplary embodiment, the first to third pressing parts 110, 120, and 130 may be arranged to be spaced apart from each other in the first direction DR1.

The first to third pressing parts 110, 120, and 130 may be configured to be independently operated. For example, each of the first to third pressing parts 110, 120, and 130 may be configured to have an independently-changeable length in the third direction DR3. The pressure to be exerted on the polishing pads 200 and the substrate SUB may be controlled by adjusting a change in length of each of the first to third pressing parts 110, 120, and 130. In other words, the length, in the third direction DR3, of the pressing unit 100 may be adjusted to control a polishing strength exerted on the substrate SUB.

The polishing pads 200 may be coupled to the pressing unit 100. The polishing pads 200 may be provided between the substrate SUB and the pressing unit 100 and may become in contact with the substrate SUB, when pressure from the pressing unit 100 is exerted on the polishing pads 200. During the polishing process, the polishing pads 200 may polish the substrate SUB with a strength corresponding to the pressure from the pressing unit 100.

The polishing pads 200 may be configured to exert a frictional force on the substrate SUB. The frictional forces of the polishing pads 200 may be used to planarize the top surface of the substrate SUB. Various materials may be used as the polishing pads 200. For example, the polishing pads 200 may be formed of or include at least one of cloth, leather, suede, or porous fiber. However, the inventive concept is not limited to this example, and in an exemplary embodiment, any material may be used as the polishing pads 200, if it can be used to exert a frictional force having a specific magnitude on the substrate SUB.

The polishing pads 200 may include first to third polishing pads 210, 220, and 230. The first to third polishing pads 210, 220, and 230 may be spaced apart from each other in the direction of the relative motion DR-S of the substrate SUB. That is, in the present exemplary embodiment, the first to third polishing pads 210, 220, and 230 may be spaced apart from each other in the first direction DR1.

The first to third polishing pads 210, 220, and 230 may be coupled to the first to third pressing parts 110, 120, and 130, respectively. Thus, a contact property or distance between the first to third polishing pads 210, 220, and 230 and the substrate SUB may be independently controlled by the first to third pressing parts 110, 120, and 130, respectively. This will be described in more detail below.

The nozzle part 300 may be used to supply slurry onto the substrate SUB. The nozzle part 300 may be disposed between the first to third pressing parts 110, 120, and 130. Accordingly, the slurry may be supplied onto the substrate SUB through respective gap regions between the first and second pressing parts 110 and 120 and between the second and third pressing parts 120 and 130. This will be described in more detail below.

The rotary unit 400 may be configured to allow the pressing unit 100, the polishing pads 200, and the nozzle part 300 to be coupled thereto. The rotary unit 400 may be used to control the motions of the pressing unit 100, the polishing pads 200, and the nozzle part 300 on a plane.

The rotary unit 400 may include a body part 410, a rotary part 420, and a supporting part 430. The body part 410 may include a rotary motor. The body part 410 may allow the rotary part 420 to execute a circular motion about a central axis RX. In an embodiment, the circular motion of the rotary part 420 may mean a revolving motion around the central axis RX, the body part 410 may be fixed to the central axis RX during the revolving motion of the rotary part 420. This will be described in more detail below.

The rotary part 420 may be provided between the body part 410 and the supporting part 430. The rotary part 420 may be coupled to the body part 410 in a movable manner and may be coupled to the supporting part 430 in a fixed manner. The supporting part 430 may be coupled to the rotary part 420 in such a way that its motion is determined by the motion of the rotary part 420. Thus, the supporting part 430 may be configured to execute a circular motion, along with the rotary part 420, when viewed in a plan view.

However, the inventive concept is not limited to this example, and in an exemplary embodiment, the body part 410 may be configured to be linearly movable in the first direction DR1 or in the second direction DR2. According to an exemplary embodiment of the inventive concept, the motions of the pressing unit 100, the polishing pads 200, and the nozzle part 300 on a plane may be determined by the motions of the body and rotary parts 410 and 420. Thus, even when there is no movement of the substrate SUB caused by the stage ST, the pressing unit 100, the polishing pads 200, and the nozzle part 300 may be linearly and rotationally moved on the plane to polish the entire top surface of the substrate SUB. However, the inventive concept is not limited to this example, and in an exemplary embodiment, the substrate polishing apparatus PA may be configured to perform a polishing process through a combination of various movements, which is selected depending on a size, an area, and/or a shape of the substrate SUB.

According to an exemplary embodiment of the inventive concept, the substrate polishing apparatus PA may include a plurality of the polishing pads 200 spaced apart from each other in the first direction DR1. Furthermore, the substrate polishing apparatus PA may include the nozzle part 300, which is configured to supply the slurry into gap regions between the polishing pads 200. Accordingly, the substrate polishing apparatus PA may be used to efficiently perform a polishing process on an area of a target object (e.g., the substrate SUB) that is overlapped with the substrate polishing apparatus PA when viewed in a plan view (hereinafter, "an effective area"). That is, according to an exemplary embodiment of the inventive concept, the efficiency of the polishing process may be improved within the effective area. This will be described in more detail below.

Figure 2:
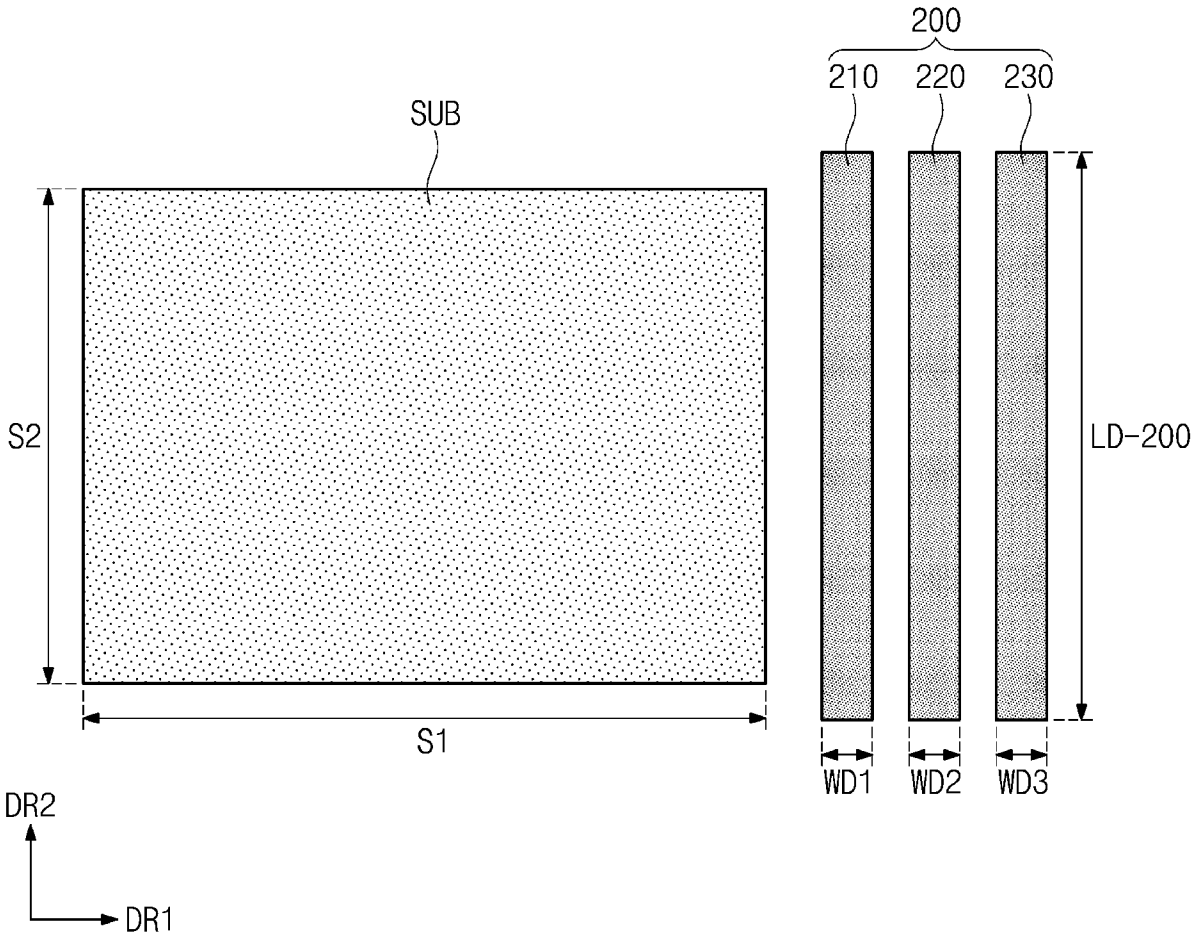
FIG. 2 is a plan view illustrating a portion of a substrate polishing apparatus according to an exemplary embodiment of the inventive concept.
Figure 3:
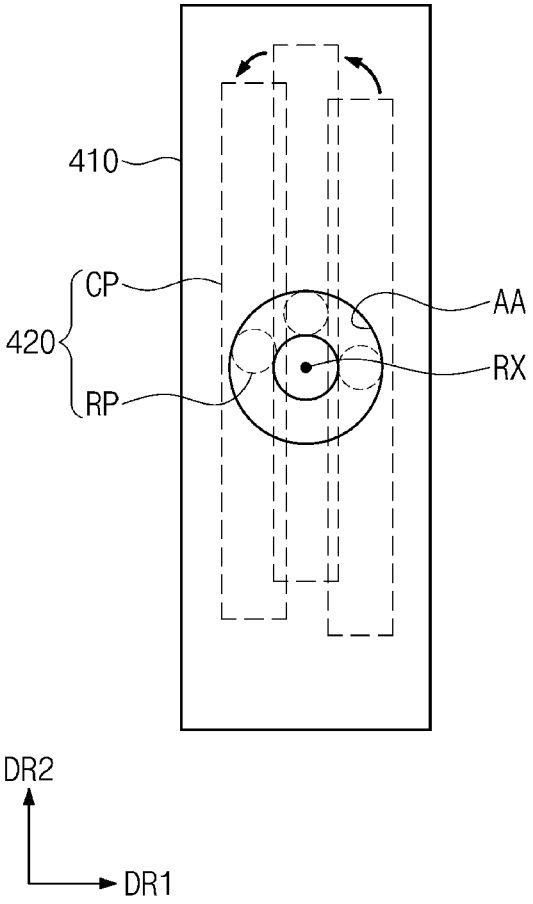
FIG. 3 is a plan view illustrating a portion of a substrate polishing apparatus according to an exemplary embodiment of the inventive concept.
Figure 4:
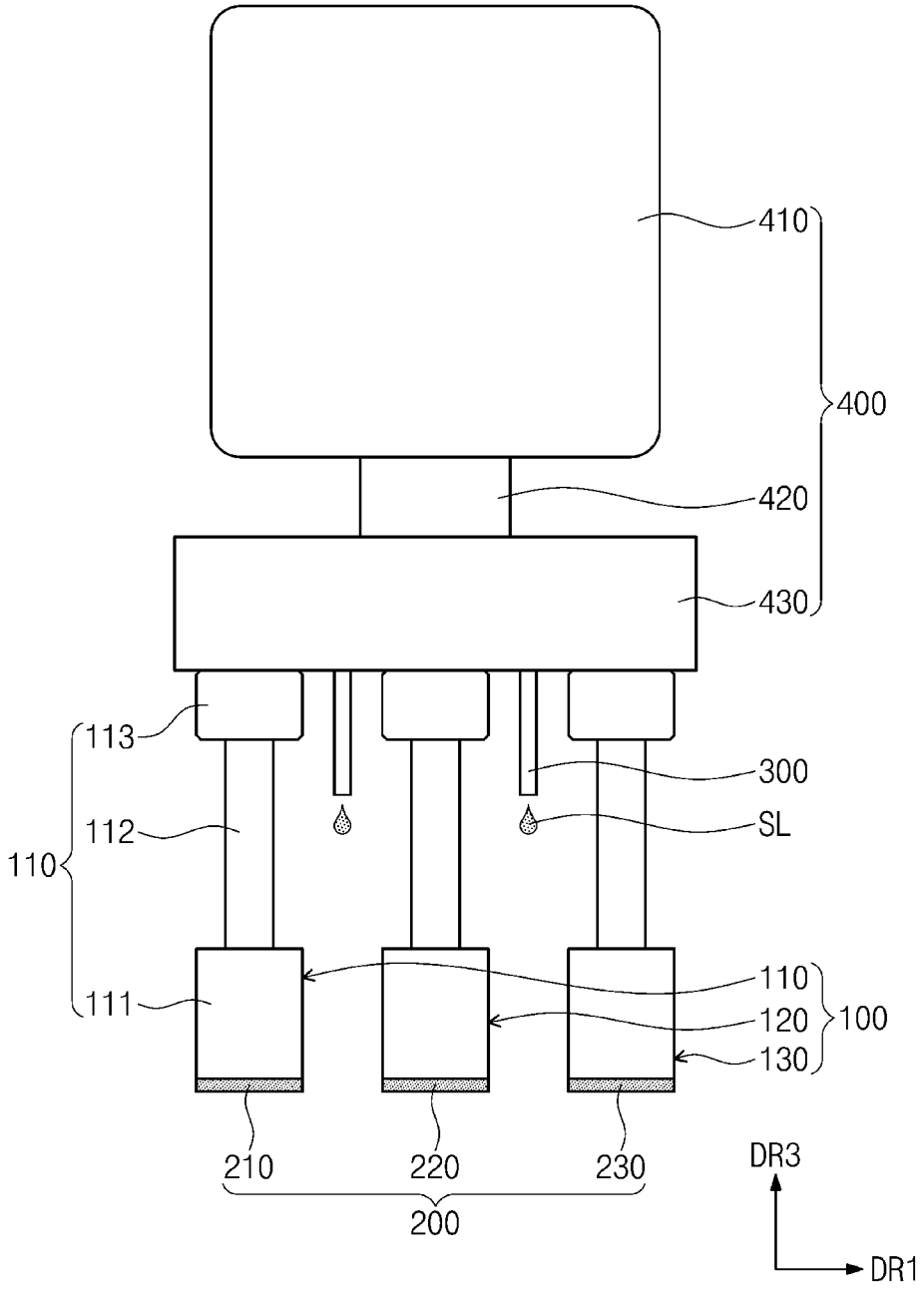
FIG. 4 is a sectional view illustrating a portion of a substrate polishing apparatus according to an exemplary embodiment of the inventive concept.

FIG. 2 is a plan view illustrating a portion of a substrate polishing apparatus PA according to an exemplary embodiment of the inventive concept. FIG. 3 is a plan view illustrating a portion of a substrate polishing apparatus PA according to an exemplary embodiment of the inventive concept. FIG. 4 is a sectional view illustrating a portion of a substrate polishing apparatus PA according to an exemplary embodiment of the inventive concept. Hereinafter, a substrate polishing apparatus PA according to an exemplary embodiment of the inventive concept will be described in more detail with reference to FIGS. 2 to 4. For concise description, an element previously described with reference to FIG. 1 may be identified by the same reference number without repeating an overlapping description thereof.

For convenience in description, only the substrate SUB and the polishing pads 200 are illustrated in FIG. 2. As shown in FIG. 2, the substrate SUB may include long sides 51 parallel to the first direction DR1 and short sides S2 parallel to the second direction DR2. In the present exemplary embodiment, the relative motion DR-S of the substrate SUB may be performed in the direction parallel to the long side 51 of the substrate SUB.

Here, each of the first to third polishing pads 210, 220, and 230 constituting the polishing pads 200 may have a tetragonal or rectangular shape and may be placed in such a way that its width and length are measured in the first and second directions DR1 and DR2, respectively. In an exemplary embodiment, when measures in the first direction DR1, the first, second, and third polishing pads 210, 220, and 230 may be provided to have first, second, and third widths WD1, WD2, and WD3, respectively.

The first to third widths WD1, WD2, and WD3 may be the same as or different from each other. In the case where the number of the polishing pads in the polishing pads 200 is n, a width of each of the polishing pads 200 may be less than W/n, where W is a width of the effective area. The effective area may be an area, which is occupied by the pressing unit 100, and may correspond to a planar area of the supporting part 430 connected to the pressing unit 100 (e.g., see FIG. 4). For example, the width of the effective area may be substantially equal to a width of the supporting part 430 measured in the first direction DR1.

For example, if the width of the supporting part 430 in the first direction DR1 is about 100 mm, each of the first to third widths WD1, WD2, and WD3 may be less than about 100 mm. In detail, each of the first to third widths WD1, WD2, and WD3 may be a width that is less than 100 mm/n. For example, each of the first to third widths WD1, WD2, and WD3 may be less than about 25 mm. The larger each of the first to third widths WD1, WD2, and WD3, the shorter the process time taken to polish the substrate SUB. By contrast, the smaller each of the first to third widths WD1, WD2, and WD3, the higher the minuteness and accuracy in the process of polishing the substrate SUB.

The first to third polishing pads 210, 220, and 230 may each have a length LD-200 that is at least greater than a length of the short side S2 of the substrate SUB. Even when the substrate SUB has a large area for realizing a large-sized display device, the length LD-200 of the first to third polishing pads 210, 220, and 230 may be greater than the length of the short side S2 of the substrate SUB. Accordingly, even when the first to third polishing pads 210, 220, and 230 polish the substrate SUB while executing a revolving motion by the rotary unit 400 (e.g., see FIG. 1), the entire top surface of the substrate SUB may be stably polished through the relative motion DR-S of the substrate SUB, without the linear motion, in the second direction DR2, of the first to third polishing pads 210, 220, and 230. This may make it possible to reduce a process time and a process cost.

In the present exemplary embodiment, the first to third polishing pads 210, 220, and 230 are illustrated to each have the same length (i.e., the length LD-200) in the second direction DR2. However, the inventive concept is not limited to this example, and in an exemplary embodiment, the first to third polishing pads 210, 220, and 230 may each have at least two different lengths.

Hereinafter, the rotary unit 400 will be described in more detail with reference to FIG. 3. As depicted by the dotted line, in FIG. 3 showing the rotary unit 400, the rotary part 420 is illustrated to be overlapped with the body part 410. In addition, for convenience in description, FIG. 3 exemplarily illustrates some positions of the rotary part 420 relative to the body part 410, which is being moved over time.

The body part 410 may be provided to have a ring-shaped hole AA, whose center is located on the central axis RX. The rotary part 420 may include a first portion RP and a second portion CP. The first portion RP may be coupled to the body part 410 through the hole AA of the body part 410. The first portion RP may be coupled to the body part 410 to be movable within the hole AA. The first portion RP may be configured to revolve around the central axis RX along the hole AA.

The second portion CP may be fixedly coupled to the first portion RP. The second portion CP may be used as an element that is substantially coupled to the supporting part 430. The second portion CP and the supporting part 430 (FIG. 4) may be fixedly coupled to each other. The second portion CP may be configured to be movable along with the first portion RP. Thus, the rotary part 420 may be allowed to revolve around the central axis RX, while the body part 410 is fixed to the central axis RX. Accordingly, the supporting part 430 connected to the rotary part 420 may also be allowed to revolve around the central axis RX. As a result, the pressing unit 100, the polishing pads 200, and the nozzle part 300 coupled with the supporting part 430 may be allowed to revolve around the central axis RX, and this may make it possible to uniformly polish the entire top surface of the substrate SUB.

The pressing unit 100, the polishing pads 200, and the nozzle part 300 will be described in more detail with reference to FIG. 4. As shown in FIG. 4, the pressing unit 100 may include the first pressing part 110, the second pressing part 120, and the third pressing part 130, which are spaced apart from each other in the first direction DR1. The first pressing part 110 may include a head part 111, an extension part 112, and a control part 113. Each of the second pressing part 120 and the third pressing part 130 may be configured to be substantially the same as the first pressing part 110 in terms of constituents and coupling structure. Thus, the first pressing part 110 will be explained as a typical example of the pressing parts.

The head part 111 may be an element, to which the first polishing pad 210 is coupled. The head part 111 may be connected to the extension part 112. The extension part 112 may be configured to have an adjustable length in the third direction DR3, and thus, a distance between the head part 111 and the control part 113 may be controlled. The extension part 112 may be configured to be partially inserted in or ejected from the control part 113. Alternatively, the control part 113 may exert a specific pressure on the extension part 112 to pull or push the extension part 112. However, the inventive concept is not limited to these examples, and in an exemplary embodiment, the structure of the pressing unit 100 may be variously changed, if it is configured to allow for the vertical motion of the head part 111 in the third direction DR3.

The nozzle part 300 may be disposed between the polishing pads 200. For example, a plurality of the nozzle parts 300 may be respectively provided between the first and second pressing parts 110 and 120 and between the second and third pressing parts 120 and 130. The nozzle part 300 may be used to supply a slurry SL into gap regions between the first and second polishing pads 210 and 220 and the second and third polishing pads 220 and 230.

In the present exemplary embodiment, the nozzle part 300 may be connected to the supporting part 430. Accordingly, the supporting part 430 may further include a slurry supply source, which is configured to supply the slurry SL. However, the inventive concept is not limited to this example, and in an exemplary embodiment, the nozzle part 300 may be connected to an additional slurry supply source, which is provided outside the supporting part 430 and is used to supply the slurry SL.

The slurry SL may include solvent and a polishing agent, which is dispersed or dissolved in the solvent. The polishing agent may include at least one of inorganic materials (e.g., metal oxides). The slurry SL may further include at least one of an oxidizing agent, a dispersing agent, a stabilizer, and a PH regulator.

According to an exemplary embodiment of the inventive concept, the slurry SL may be provided into a gap region between the polishing pads 200. Thus, the slurry SL may be more easily provided to each of the first to third polishing pads 210, 220, and 230, which are spaced apart from each other, when compared to the case that the nozzle part 300 is provided outside the polishing pads 200. Accordingly, a target surface to be polished by the polishing pads 200 may be uniformly exposed to the slurry SL. As a result, it may be possible to uniformly polish the target surface.

Figure 5A:
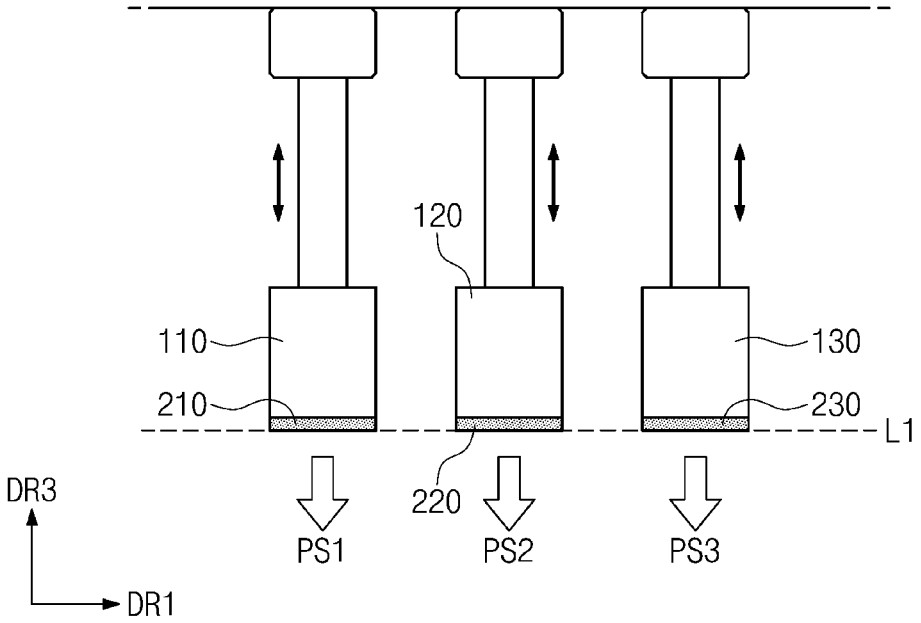
FIGS. 5A and 5B are sectional views illustrating a portion of a substrate polishing apparatus according to an exemplary embodiment of the inventive concept.
Figure 5B:
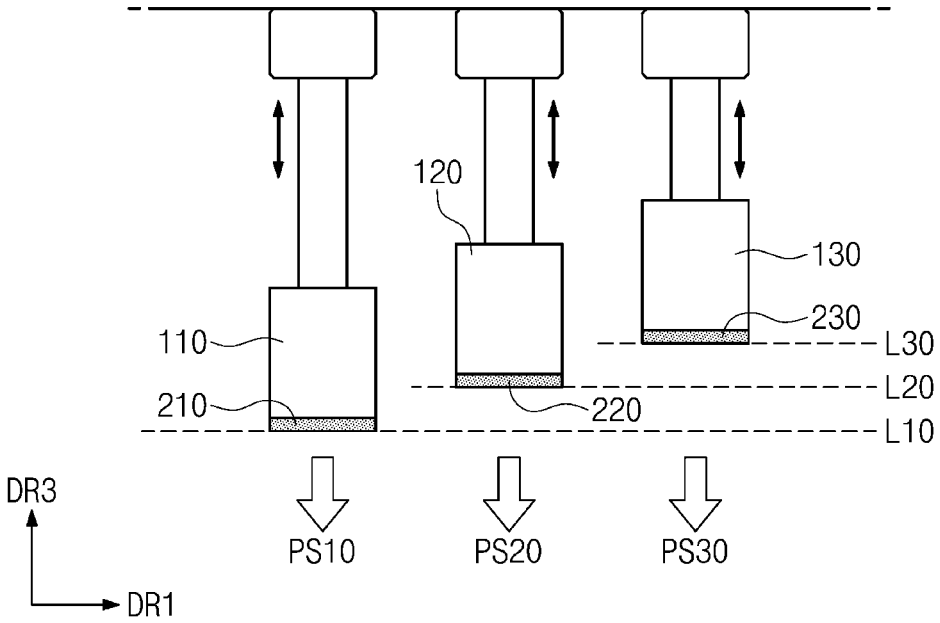

FIGS. 5A and 5B are sectional views illustrating a portion of a substrate polishing apparatus PA according to an exemplary embodiment of the inventive concept. The sectional views of FIGS. 5A and 5B show two different operation states of the pressing unit 100, which are realized in the same substrate polishing apparatus PA. Hereinafter, a substrate polishing apparatus PA according to an exemplary embodiment of the inventive concept will be described in more detail with reference to FIGS. 5A and 5B. For concise description, an element previously described with reference to FIGS. 1 to 4 may be identified by the same reference number without repeating an overlapping description thereof.

As shown in FIG. 5A, in the substrate polishing apparatus PA, the first to third pressing parts 110, 120, and 130 of the pressing unit 100 may be configured to exert a uniform pressure on a substrate (not shown). Each of the first to third pressing parts 110, 120, and 130 may be moved in the third direction DR3 to adjust the pressure to be exerted on the substrate and to control a distances between a corresponding one of the first to third polishing pads 210, 220, and 230 and the substrate.

The first to third pressing parts 110, 120, and 130 may be simultaneously moved to allow the first to third polishing pads 210, 220, and 230 to have bottom surfaces aligned to a first virtual line L1. Thus, it may be possible for the first to third pressing parts 110, 120, and 130 to exert substantially the same pressure on the first to third polishing pads 210, 220, and 230, and in this case, pressures PS1, PS2, and PS3 of the first to third polishing pads 210, 220, and 230 exerted on the substrate may have the same magnitude.

According to an exemplary embodiment of the inventive concept, the pressing unit 100 may be configured to polish a substrate, while exerting a uniform pressure on a corresponding area of the substrate. As a result, it may be possible to improve uniformity of a polishing process.

Alternatively, as shown in FIG. 5B, the first to third pressing parts 110, 120, and 130 may be independently controlled. For example, the first to third pressing parts 110, 120, and 130 may be configured to exert different pressures on the substrate or to independently control distances between the first to third polishing pads 210, 220, and 230 and the substrate.

In detail, the first to third pressing parts 110, 120, and 130 may be controlled to allow the first to third polishing pads 210, 220, and 230 to have bottom surfaces aligned to different virtual lines. For example, the first pressing part 110 may be controlled to align the first polishing pad 210 to a first virtual line L10, the second pressing part 120 may be controlled to align the second polishing pad 220 to a second virtual line L20, and the third pressing part 130 may be controlled to align the third polishing pad 230 to a third virtual line L30.

Thus, first, second, and third pressures PS10, PS20, and PS30, which are pressures of the first, second, and third polishing pads 210, 220, and 230 to be exerted on the substrate, may be independently controlled. According to an exemplary embodiment of the inventive concept, since the first to third pressures PS10, PS20, and PS30 are independently controlled, it may be possible to realize a difference in polished amount from region to region and thereby to improve accuracy of a polishing process.

Figure 6A:
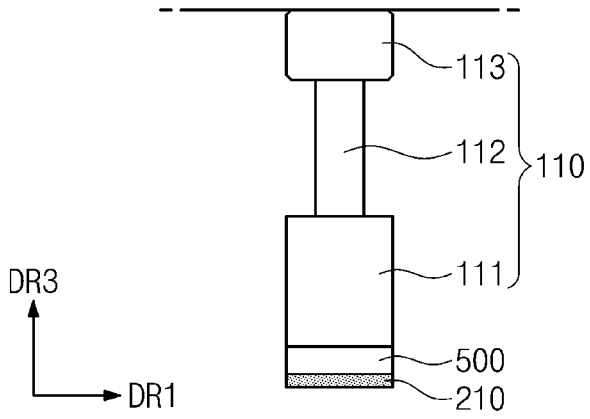
FIGS. 6A, 6B, and 6C are sectional views illustrating a portion of a substrate polishing apparatus according to an exemplary embodiment of the inventive concept.
Figure 6B:
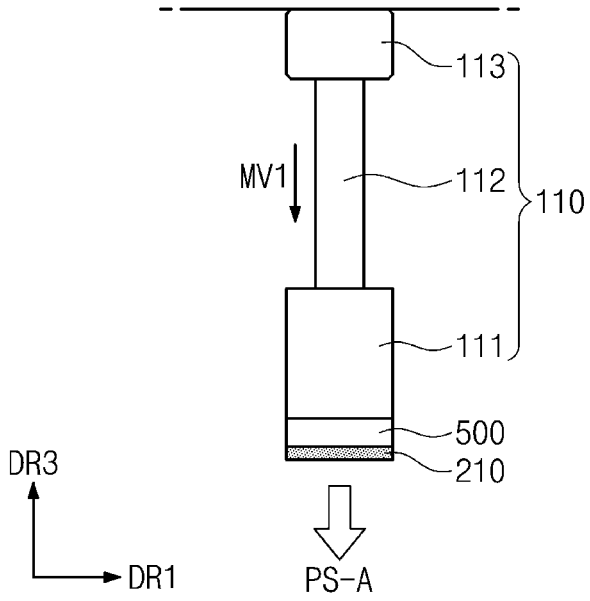
Figure 6C:
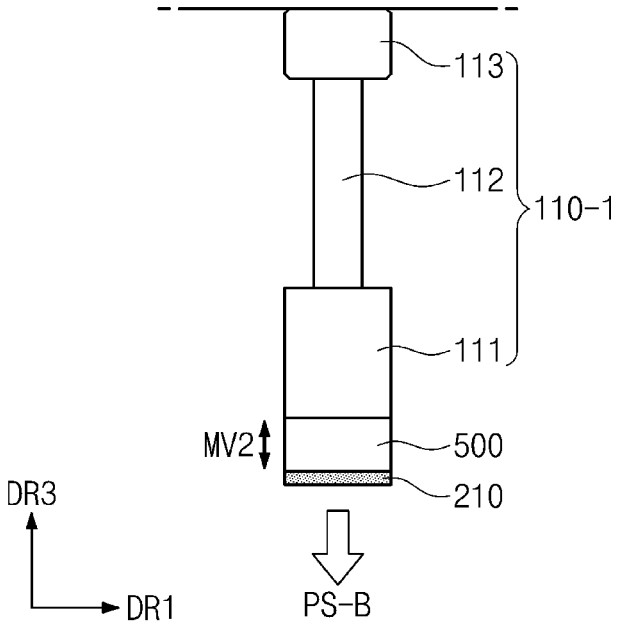

FIGS. 6A to 6C are sectional views illustrating a portion of a substrate polishing apparatus PA according to an exemplary embodiment of the inventive concept. FIGS. 6A to 6C illustrate some operational states of the first pressing part 110 schematically. Technical features of the first pressing part 110 to be described with reference to FIGS. 6A and 6B may be applied for the second and third pressing parts 120 and 130 (e.g., see FIG. 1) in the same or similar manner. Thus, hereinafter, the first pressing part 110 (hereinafter, a pressing part) will be described in more detail. For concise description, an element previously described with reference to FIGS. 1 to 5B may be identified by the same reference number without repeating an overlapping description thereof.

Referring to FIGS. 6A to 6C, the substrate polishing apparatus PA may further include a swelling part 500. The swelling part 500 may be disposed between the first head part 111 (hereinafter, a head part) and the first polishing pad 210 (hereinafter, a polishing pad). The swelling part 500 may be configured in such a way that its thickness in the third direction DR3 is changed by an internal pressure exerted thereon. In this case, a pressure, which is exerted on the polishing pad 210 or is exerted on the substrate SUB (e.g., see FIG. 1) by the polishing pad 210, may be changed depending on the change in thickness of the swelling part 500.

For example, in the case where a positive internal pressure is exerted on the swelling part 500 or an amount of the air injected into the swelling part 500 is increased, the swelling part 500 may be expanded to have an increased thickness in the third direction DR3. By contrast, in the case where a negative internal pressure is exerted on the swelling part 500 or an amount of the air ejected from the swelling part 500 is increased, the swelling part 500 may be contracted to have a reduced thickness in the third direction DR3.

In detail, as shown in FIG. 6B, in the case where a first movement MV1 of the extension part 112 occurs in the pressing part 110, the first polishing pad 210 may exert a first pressure PS-A on a substrate (not shown). The first movement MV1 may correspond to an increase of the length, in the third direction DR3, of the extension part 112. The first pressure PS-A may be produced when the extension part 112 is elongated through the first movement MV1 (e.g., changed from the state of FIG. 6A to the state of FIG. 6B).

Thereafter, as shown in FIG. 6C, in the case where a second movement MV2 of the swelling part 500 occurs, the first polishing pad 210 may exert a second pressure PS-B on a substrate. The second movement MV2 may result from the expansion of the swelling part 500. The second pressure PS-B may be greater than the first pressure PS-A.

According to an exemplary embodiment of the inventive concept, since the substrate polishing apparatus PA may further include the swelling part 500, the substrate polishing apparatus PA may exert the second pressure PS-B, which is greater than the first pressure PS-A, on the substrate. Since the pressure is increase, it may be possible to increase the polishing force exerted on the substrate. Furthermore, the expansion of the swelling part 500 may be easily and precisely controlled. This may make it possible to precisely control the pressure to be exerted on the substrate and thereby to improve accuracy of the polishing process.

Figure 7:
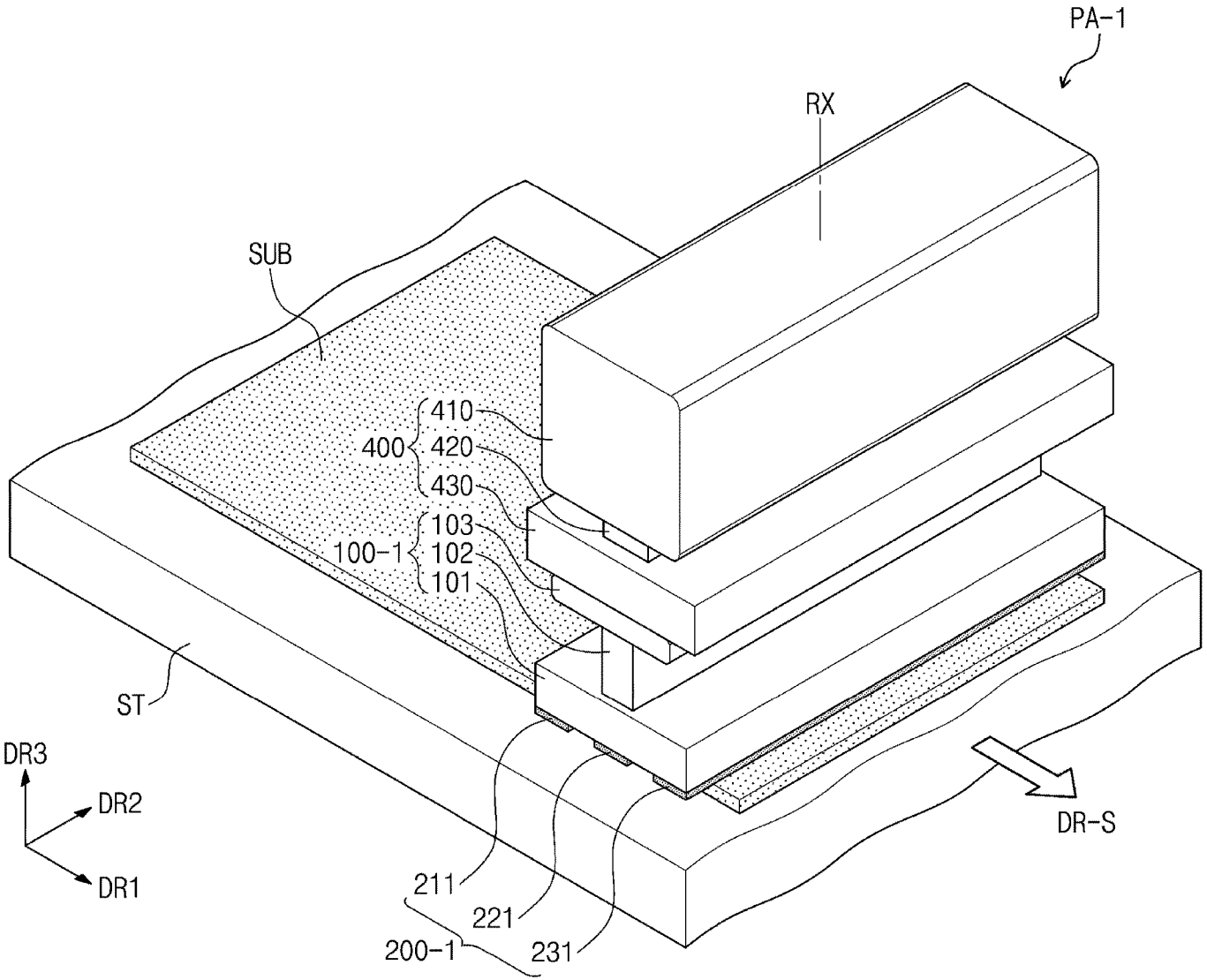
FIG. 7 is a perspective view illustrating a substrate polishing apparatus according to an exemplary embodiment of the inventive concept.
Figure 8:
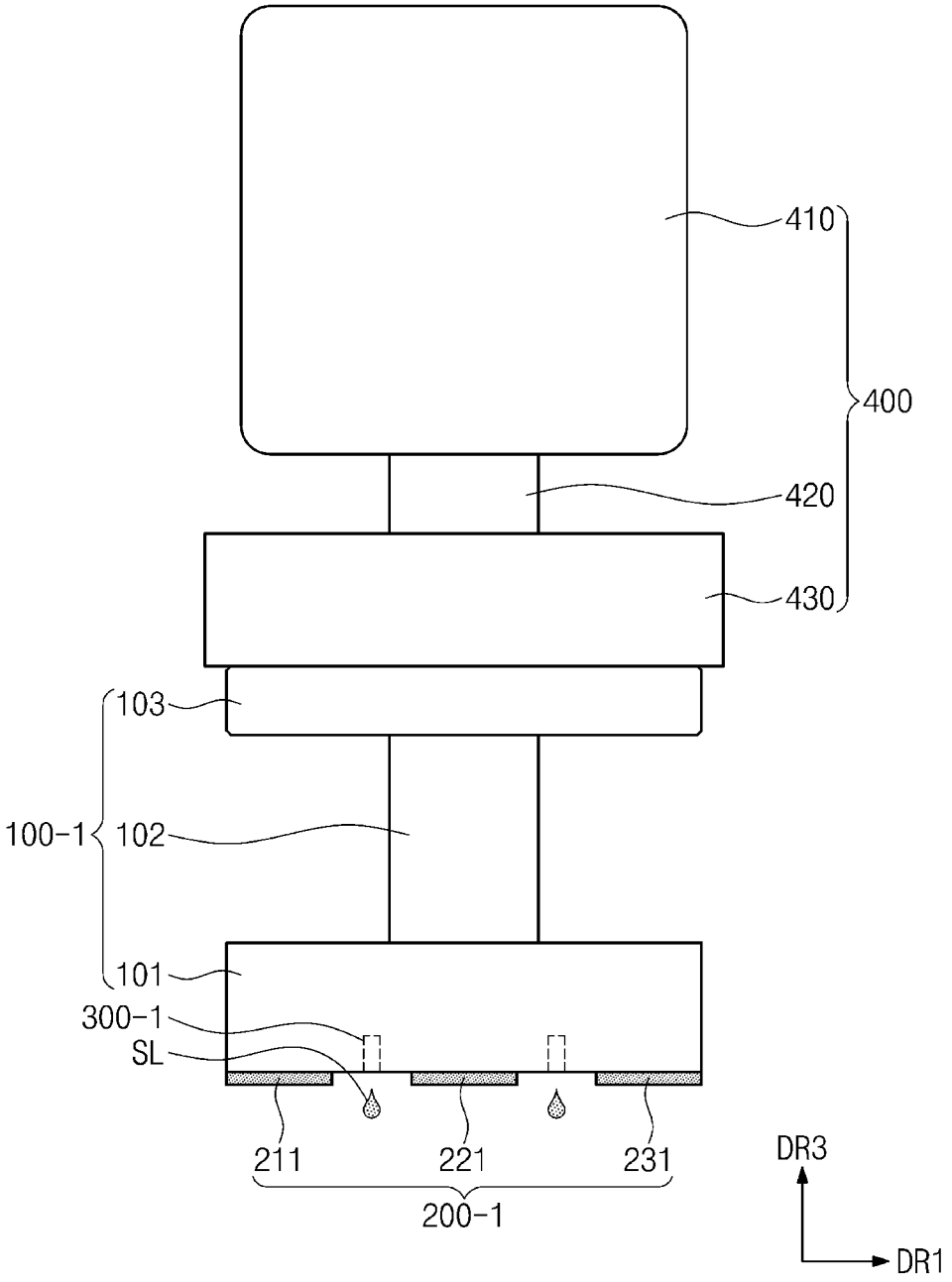
FIG. 8 is a side view of the substrate polishing apparatus of FIG. 7.

FIG. 7 is a perspective view illustrating a substrate polishing apparatus PA-1 according to an exemplary embodiment of the inventive concept. FIG. 8 is a side view of the substrate polishing apparatus PA-1 of FIG. 7. Hereinafter, a substrate polishing apparatus PA-1 according to an exemplary embodiment of the inventive concept will be described in more detail with reference to FIGS. 7 and 8. For concise description, an element previously described with reference to FIGS. 1 to 6C may be identified by the same reference number without repeating an overlapping description thereof.

A substrate polishing apparatus PA-1 may include a pressing unit 100-1, a plurality of polishing pads 200-1, a nozzle part 300-1, and a rotary unit 400. The rotary unit 400 may be configured to have substantially the same features as the rotary unit 400 of FIG. 1, and thus, a detailed description thereof will be omitted.

The pressing unit 100-1 may include a head part 101, an extension part 102, and a connecting part 103. The head part 101 may be an element, to which the polishing pads 200-1 are coupled. In the present exemplary embodiment, the head part 101 may be provided in the form of a single body.

The extension part 102 may be fixedly coupled to the head part 101. A length of the extension part 102 may be changed to control a distance between the head part 101 and the connecting part 103. A portion of the extension part 102 may be configured to be inserted in or ejected from the connecting part 103, and thus, the extension part 102 may have an easily changeable length.

The polishing pads 200-1 may include first to third polishing pads 211, 221, and 231, which are spaced apart from each other in the first direction DR1. The first to third polishing pads 211, 221, and 231 may be coupled in common to a single head part (i.e., the head part 101). According to an exemplary embodiment of the inventive concept, the first to third polishing pads 211, 221, and 231 may be configured to uniformly exert a pressure, which is provided through the head part 101, on a substrate. Thus, it may be possible to improve uniformity of a substrate polishing process.

The nozzle part 300-1 may be provided between the first to third polishing pads 211, 221, and 231 to supply the slurry SL onto the substrate SUB. The nozzle part 300-1 may be provided in the head part 101. For example, the nozzle part 300-1 may be inserted in the head part 101. The nozzle part 300-1 may be provided in an internal region of the head part 101 and may not be exposed to the outside, as depicted in the sectional view of FIG. 8. However, the inventive concept is not limited to this example, and in an exemplary embodiment, the nozzle part 300-1 may be provided to be exposed from the bottom surface of the head part 101.

The head part 101 may further include an additional storage, which is used to store the slurry SL. However, the inventive concept is not limited to this example, and in an exemplary embodiment, the nozzle part 300-1 may be configured to receive the slurry SL from an additional slurry storing device.

Figure 9A:
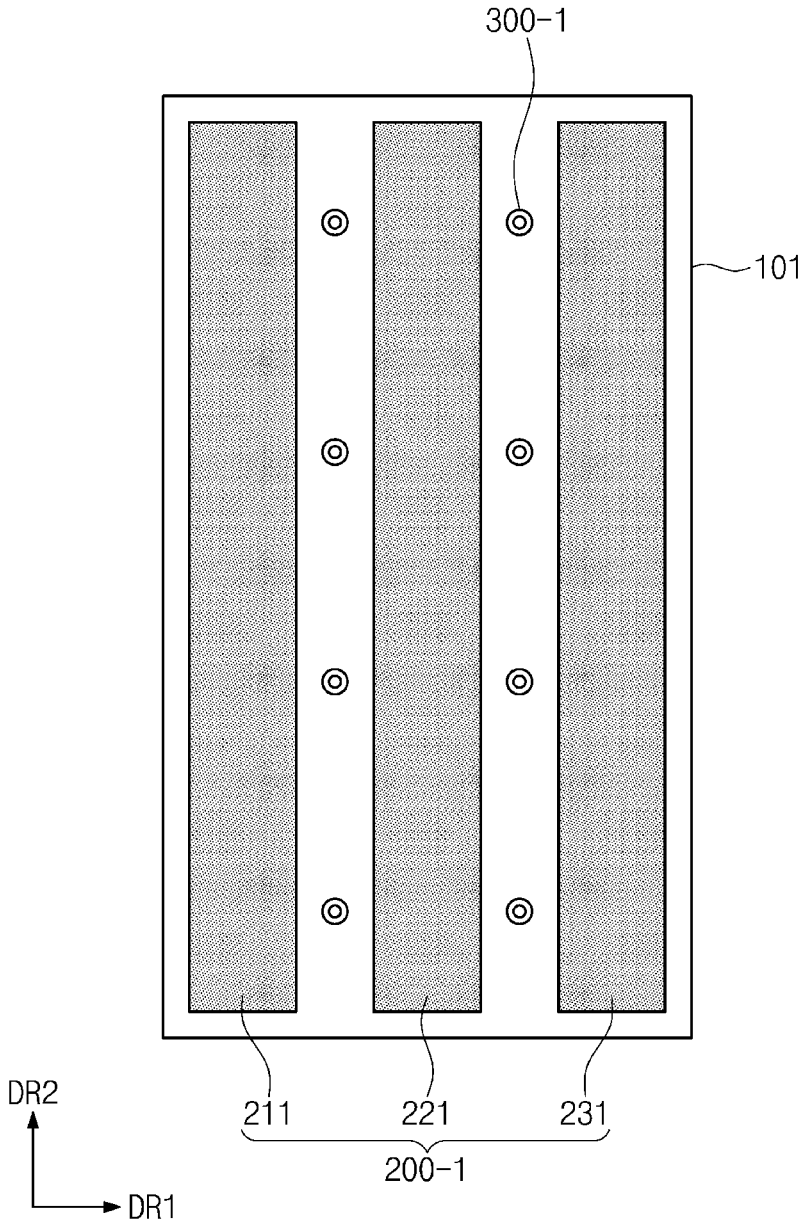
FIGS. 9A and 9B are plan views schematically illustrating a portion of a substrate polishing apparatus according to an exemplary embodiment of the inventive concept.
Figure 9B:
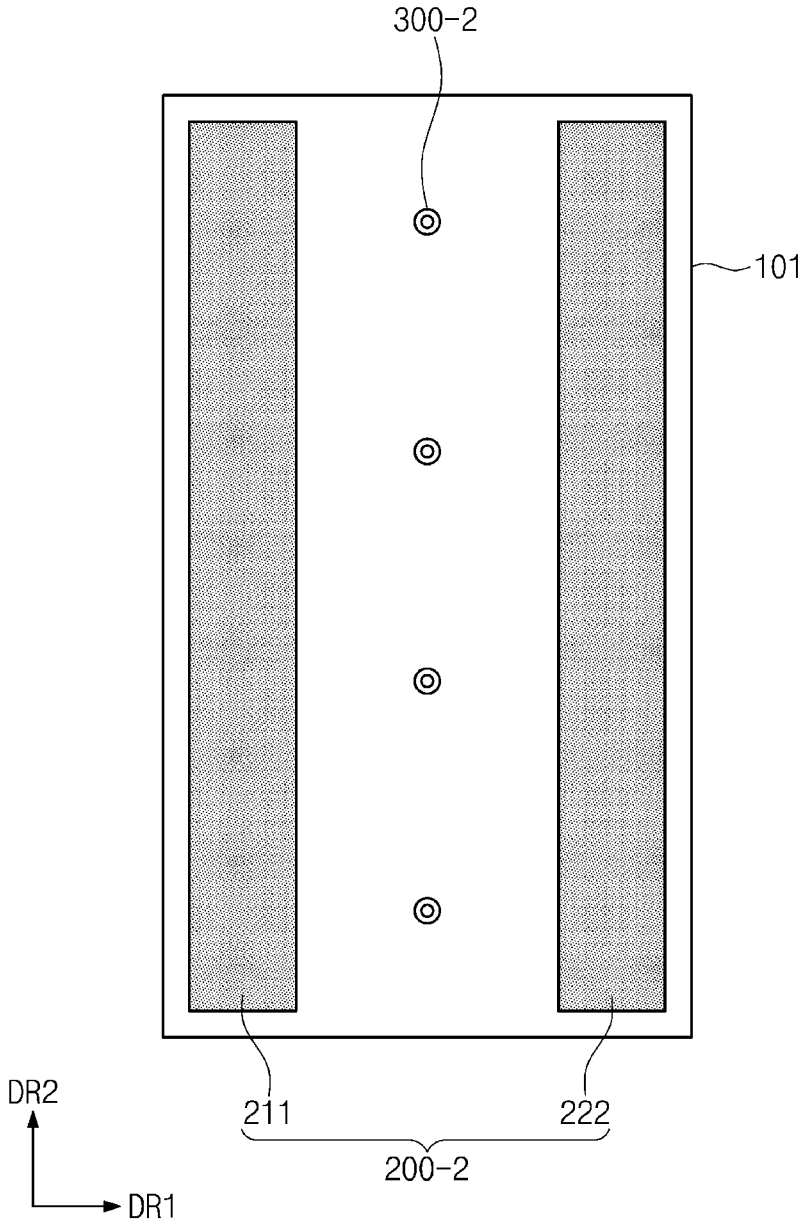

FIGS. 9A and 9B are plan views schematically illustrating a portion of a substrate polishing apparatus according to an exemplary embodiment of the inventive concept. In detail, FIGS. 9A and 9B are bottom plan views of the head part 101. Hereinafter, the inventive concept will be described with reference to FIGS. 9A and 9B.

As shown in FIG. 9A, the nozzle part 300-1 according to an exemplary embodiment of the inventive concept may be provided in the head part 101. For example, the nozzle part 300-1 may be provided in bottom regions of the head part 101, which are located between the first and second polishing pads 211 and 221 and between the second and third polishing pads 221 and 231.

The nozzle part 300-1 may be a plurality of holes. The holes may be spaced apart from each other in the first and second directions DR1 and DR2. The substrate polishing apparatus PA may supply a slurry through the nozzle part 300-1. Thus, the slurry may be supplied between the first to third polishing pads 211, 221, and 231, and in this case, each of the first to third polishing pads 211, 221, and 231 may uniformly polish the substrate using the slurry.

As shown in FIG. 9B, polishing pads 200-2 may have two polishing pads (e.g., a first polishing pad 211 and a second polishing pad 222), which are spaced apart from each other in the first direction DR1. Here, the head part 101 may be configured to have the same area and the same shape as the head part 101 of FIG. 9A.

A nozzle part 300-2 may be provided between the first and second polishing pads 211 and 222. The nozzle part 300-2 may be provided to have a plurality of holes, which are spaced apart from each other in the second direction DR2 and are defined in the head part 101.

The inventive concept will be described in more detail with reference to the following Table 1.

TABLE 1

| Classification | Scan (times) | Width of Polishing Pad (mm) | Number Of Polishing Pads | Width Of Target Surface (mm) | Polishing State |
|---|---|---|---|---|---|
| Comparative Example | 4 | 100 | 1 | 100 | Un-polished |
| Example embodiment A | 2 | 25 | 2 | 100 | Polished |

Table 1 summarizes surface states of target surfaces that were polished using substrate polishing apparatuses according to a Comparative example and an Example embodiment A. In the substrate polishing apparatus according to the Comparative example, a single polishing pad, which was provided to cover the entire surface of the target surface, was used to polish the target surface. In contrast, in the substrate polishing apparatus according to the Example embodiment A, the polishing pads 200-2 shown in FIG. 9B were used to polish the target surface. In the Example embodiment A, the width of each of the first and second polishing pads 211 and 222 was 25 mm. In the present exemplary embodiment, the target surface may have same area with a bottom surface of the head part 101. In the comparative example and the Example embodiment A, the polishing pads were formed of the same material and the slurries also were formed of the same material. For the Comparative example, although the polishing pad covering substantially the entire surface of the target surface was used and the number of the scans was greater, the target surface had an unpolished state. By contrast, for the example embodiment A, even though the total width of the polishing pads was half of the width of the target surface and the number of scans was less than that of the Comparative example, the target surface had a polished state.

As described above, the polishing efficiency of a substrate polishing apparatus is more chiefly dependent on the number of the polishing pad than on an area of the polishing pad. Thus, since, according to an exemplary embodiment of the inventive concept, a plurality of polishing pads 200-1 or 200-2 are used to span a given effective area, it may be possible to improve efficiency of the polishing process on the given effective area.

According to an exemplary embodiment of the inventive concept, provided is a substrate polishing apparatus, which is configured to improve a polishing efficiency in a polishing process on a target surface. In addition, according to an exemplary embodiment of the inventive concept, provided is a substrate polishing apparatus, which is configured to improve uniformity and precision of a polishing process.

Although certain exemplary embodiments have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A substrate polishing apparatus, comprising:

a stage having a flat surface, which is parallel to a first direction and a second direction, and configured to support a substrate;

a pressing unit configured to exert a pressure on the substrate in a third direction perpendicular to the first and second directions at a position overlapping the stage;

a rotary unit connected to the pressing unit, the rotary unit being configured to revolve the pressing unit around a central axis parallel to the third direction, when viewed in a plan view;

a plurality of polishing pads provided between the pressing unit and the substrate and used to polish the substrate; and a nozzle part configured to supply a slurry onto the substrate, wherein:

the polishing pads are spaced apart from each other in a direction parallel to a motion of the substrate;

when measured in the second direction, a length of each of the polishing pads is greater than a length of the substrate;

each of the polishing pads has a rectangular shape in a plan view;

the rotary unit comprises a body part and a rotary part that executes a circular motion about the central axis with respect to the body part;

the rotary part includes a rectangular portion that is longer in the second direction than the first direction;

the body part defines a ring-shaped groove on a surface thereof facing the third direction; and wherein the rotary part includes a circular portion coupled to the body part so as to be movable within the ring-shaped groove.

2. The substrate polishing apparatus of claim 1, wherein the nozzle part is provided between the polishing pads.

3. The substrate polishing apparatus of claim 2, wherein:

the pressing unit comprises a plurality of pressing parts, which are spaced apart from each other in the first direction; and the polishing pads are coupled to the pressing parts, respectively.

4. The substrate polishing apparatus of claim 3, wherein all of the pressing parts are configured to exert a same pressure on the substrate.

5. The substrate polishing apparatus of claim 3, wherein the pressing parts are configured to exert different pressures on the substrate.

6. The substrate polishing apparatus of claim 3, wherein:

the nozzle part comprises a plurality of nozzle parts, which are coupled to the rotary unit; and the pressing parts and the plurality of nozzle parts are alternately arranged in the first direction.

7. The substrate polishing apparatus of claim 2, wherein:

the pressing unit comprises a single pressing part; and the polishing pads are coupled to the single pressing part.

8. The substrate polishing apparatus of claim 7, wherein the nozzle part comprises a plurality of holes, which are defined in the pressing unit and are spaced apart from each other in the second direction.

9. The substrate polishing apparatus of claim 1, wherein:

the pressing unit further comprises a swelling part provided between the pressing unit and the polishing pad; and the swelling part is configured to have a changeable thickness, thereby allowing the polishing pad to exert a pressure on the substrate.

10. The substrate polishing apparatus of claim 1, wherein the pressing unit is configured to have a changeable length in the third direction, thereby allowing the polishing pad to exert a pressure on the substrate.

11. The substrate polishing apparatus of claim 1, wherein a width of each of the polishing pads in the first direction is less than 100 mm/n, where n is the number of the polishing pads.

12. The substrate polishing apparatus of claim 11, wherein the width of each of the polishing pads in the first direction is less than 25 mm.

13. The substrate polishing apparatus of claim 1, wherein the substrate comprises a glass substrate.

14. The substrate polishing apparatus of claim 1, wherein the stage is configured to move the substrate in the first direction.

15. The substrate polishing apparatus of claim 1, wherein the pressing unit is longer in the second direction than in the first direction.

16. The substrate polishing apparatus of claim 1, wherein the rectangular portion does not change orientation throughout the circular motion.

17. The substrate polishing apparatus of claim 1, wherein the body part is linearly movable in the first direction or the second direction.

* * * * *